US005749580A

United States Patent [19]

Lopez

[11] Patent Number: 5,749,580

[45] Date of Patent: May 12, 1998

[54] EDUCATIONAL BOARD GAME FOR PREPARING FOR A DRIVER'S LICENSE EXAMINATION

[76] Inventor: Gilberto Lopez, PO Box 8703, Fernandez Juncos Station, San Juan, Puerto Rico, 00910

[21] Appl. No.: 740,480

[22] Filed: Oct. 30, 1996

[51] Int. Cl.[6] ..... A63F 3/00

[52] U.S. Cl. ..... 273/243

[58] Field of Search ..... 273/242, 243, 273/248, 249, 240, 236

[56] References Cited

U.S. PATENT DOCUMENTS

| | | | |
|---|---|---|---|
| 3,939,578 | 2/1976 | Coffey | 273/243 X |
| 4,094,510 | 6/1978 | Drohomirecky | 273/251 |
| 4,216,966 | 8/1980 | McRae | 273/243 |
| 4,323,249 | 4/1982 | Brady | 273/249 |
| 4,375,889 | 3/1983 | Burkett | 273/254 |
| 4,557,485 | 12/1985 | Landon | 273/249 X |
| 4,854,594 | 8/1989 | Eaton | 273/240 X |
| 4,953,871 | 9/1990 | Antwi | 273/251 |
| 5,002,283 | 3/1991 | Langham | 273/352 |
| 5,259,623 | 11/1993 | Kanelos | 273/243 X |

FOREIGN PATENT DOCUMENTS

| | | | |
|---|---|---|---|
| 1445136 | 8/1976 | United Kingdom | 273/254 |
| 2203957 | 11/1988 | United Kingdom . | |

*Primary Examiner*—William E. Stoll
*Attorney, Agent, or Firm*—Tom Hamill, Jr.

[57] ABSTRACT

An educational board game is provided which aids the players in preparing for the driver's license examination. The game is designed to be an interactive multi-player game which includes a board, game tokens, score cards, dice and cards. The board includes a sequential pattern of rectangles which the players would move their token about in response to a throw of the dice. The sequential pattern resembles a series of interconnected rectangular and square paths of playing squares representing roadways and their associated traffic control devices and hazards. Each player will transit the board following the sequential pattern with the object of memorizing all the safety rules of the road, to obey safety signs, to obey speed limits, and to become aware of the serious problem of driving under the influence of alcohol. Questions which may appear on the examination are posed during the course of play and points will be awarded for correct answers. Scores are kept on associated scorecards. Players transit the board and the player who achieves a point score before the others satisfies the winning conditions. This game is designed to instruct an individual in the rules of the road as would be presented on the written driver's license examination. By playing often before the examination the prospective licensee may materially increase their score on the written driver's exam. The instant game may be suitable for electronic gaming as well, that is, a computer game utilizing the method of play and board layout may be provided.

16 Claims, 6 Drawing Sheets

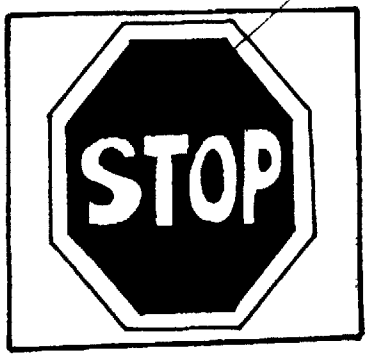
STOP FIG3
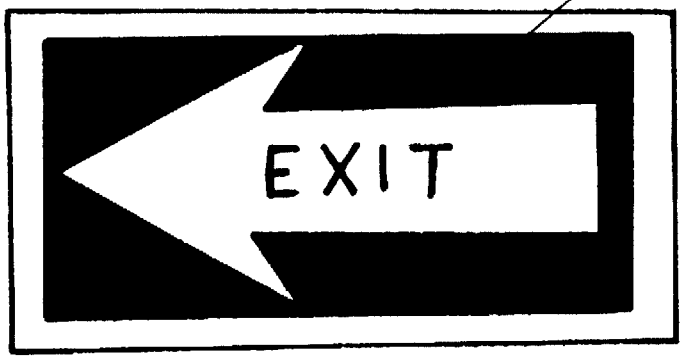
EXIT FIG2
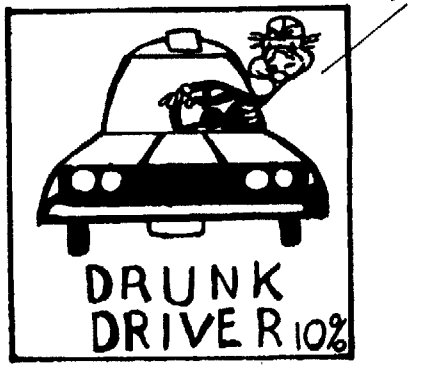
DRUNK DRIVER FIG6
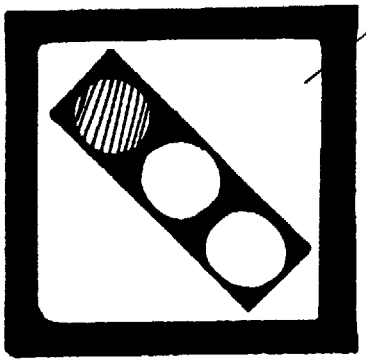
TRAFFIC LIGHT FIG5
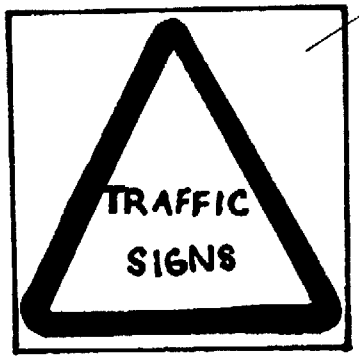
TRAFFIC SIGNS FIG4

POLICEMAN

DISABLED PERSON

QUESTION MARK

TURTLE

SCHOOL ZONE

FOLLOWING DISTANCE

DETOUR

ACCIDENT

AMBULANCE

DETOUR

DRUNK DRIVER

TRAFFIC SIGNS

QUESTIONMARK

POLICEMAN

CARDS

EDUCATIONAL BOARD GAME FOR PREPARING FOR A DRIVER'S LICENSE EXAMINATION

BACKGROUND OF THE INVENTION

1. Field of the Invention

The present invention relates generally to multi player board games and more particularly to a multi-player interactive board game especially adapted to effect the instruction of the rules of the road as would be presented on the written driver's license examination.

2. Description of the Prior Art

Board games for the instruction of the rules of the road to be played prior to taking the written driver's examination are known in the art. However, no known prior art utilizes the novel rules, method of play, and playing board of the invention.

SUMMARY OF THE INVENTION

To achieve the foregoing and other advantages, the present invention, briefly described, provides an instructional board game which aids the player in preparing for the driver's license examination. The game is designed to be an interactive multi-player game which includes a board, game tokens, score cards, dice and cards. The board includes a sequential pattern of rectangles which the players would move their token about in response to a throw of the dice. Players will carefully monitor their opponents for errors and will point out "driving" mistakes during their play. The sequential pattern generally resembles a series of interconnected rectangular and square paths of playing squares representing roadways and their associated traffic control devices and hazards. Each player will transit the board following the sequential pattern with the object of memorizing all the safety rules of the road, to obey safety signs, to obey speed limits, and to become aware of the serious problem of driving under the influence of alcohol. Scores are kept on associated scorecards. Players will be responsible for tabulating their opponent's score. Players transit the board and the player who achieves a point score before the others satisfies the winning conditions. This game is designed to instruct an individual in the rules of the road as would be presented on the written driver's license examination. By playing often before the examination the prospective licensee may materially increase their score on the written driver's exam. The instant game may be suitable for electronic gaming as well, that is, a computer game utilizing the method of play and board layout may be provided.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other board structures, instructional games, gaming methods, and systems for carrying out the several purposes of the present invention. It is important, therefore, that the claims be regarded as including such equivalent constructions insofar as they do not depart from the spirit and scope of the present invention.

It is therefore an object of the present invention to provide a new educational game for preparing an individual for the driver's license examination which includes questions which may appear on the actual driver's license exam.

It is an object of the present invention to provide a new educational game which will increase the player's score on the driver's license written examination, as well as increase the player's knowledge concerning the rules of the road.

It is another object of the present invention to provide a new educational game for preparing the player for the driver's license examination with a novel board and rules of play.

It is an another object of the present invention to provide an educational game for preparing an individual for the driver's license examination which is amusing, engrossing and desirable of repeat play.

It is another object of the present invention to provide a new educational game for preparing an individual for the driver's license examination which may be easily and efficiently manufactured and marketed.

It is a further objective of the present invention to provide a new educational game for preparing an individual for the driver's license examination which is of durable and reliable construction.

An even further object of the present invention is to provide a new and improved educational game which is susceptible of a low cost of manufacture with regard to both materials and labor, and which accordingly is then susceptible of low prices of sale to the consuming public, thereby making such an instructional game available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 2 is a view showing the playing square designated "Exit".

FIG. 3 is a view showing the playing square designated "Stop".

FIG. 4 is a view showing the playing square designated "Traffic Signs".

FIG. 5 is a view showing the playing square designated "Traffic Light".

FIG. 6 is a view showing the playing square designated "Drunk Driver".

DESCRIPTION OF THE PREFERRED EMBODIMENT

With reference now to the drawings, an educational board game which aids the player for preparing the driver's license examination is provided.

Figure 1:
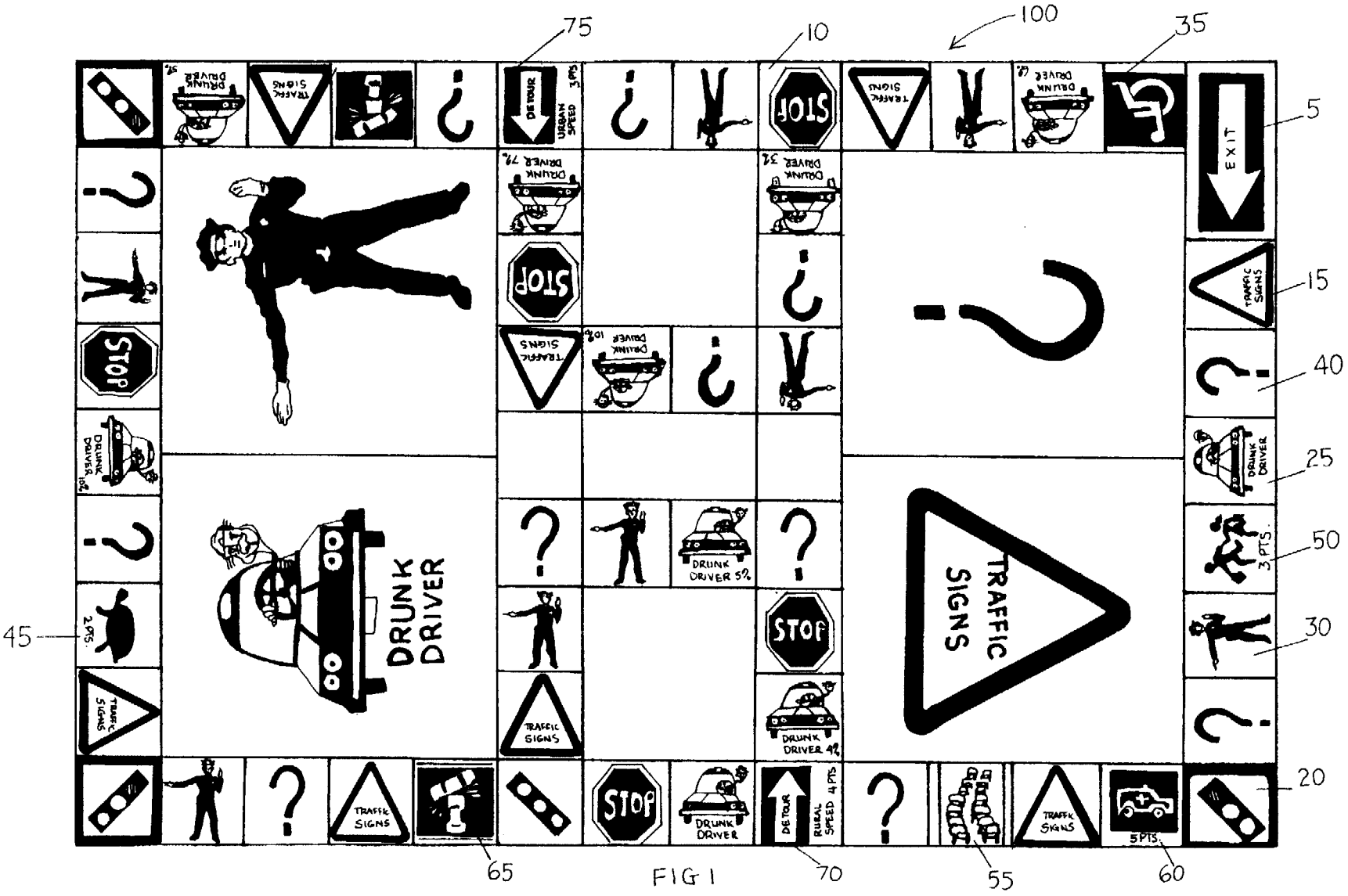
FIG. 1 is a view showing the preferred embodiment of the playing board of the invention.

Turning initially to FIG. 1, there is shown a first exemplary embodiment of the board game of the invention generally designated by reference numeral 100. In its preferred form, the board game 100 comprises a generally rectangular board with a plurality of squares located thereon. The game board may be selected to be 16 inches wide by 25 inches long. A color pattern will be chosen to reflect the color patterns commonly found on road signs and the like. Players will roll a die and move about the board, one square for each number on the present on the face of the die. The game is one where points are awarded and deducted based on the driving conduct of the player, which is simulated as they traverse the board. Points will also be awarded on the ability of the player to answer questions which are posed during the course of play. The rules of play will become obvious as the explanation of the playing board, square types, card types and associated structure is presented. There are 56 spaces located on the board with 15 types of squares being represented. The squares may best be seen in FIGS. 2–16. The Exit Square 5 is double the size of all the other squares. The Exit Square 5 acts as the 'start' point of the game, to simulate entering a roadway via an exit. Starting from Exit Square 5 the players will move their pieces in a clockwise fashion. The playing pieces will be chosen to be automobiles or the like, and will be provided in a variety of colors to discriminate between the players.

A plurality of other squares are located on the board. They include the Stop Sign Squares 10, the Traffic Signs Squares 15, the Traffic Light Squares 20, the Drunk Driver Squares 25, the Policeman Squares 30, the Disabled Person Square 35, the Question Mark Squares 40, the Turtle Square 45, the School Zone Square 50, the Following Distance Square 55, the Ambulance Square 60, the Accident Squares 65, the Rural Detour Square 70 and the Urban Detour Square 75. The squares occur in the following frequency. There are twelve Question Mark Squares 40. There are ten Drunk Driver Squares 25. There are eight Traffic Signs Squares 15. There are eight Policeman Squares 30. There are five Stop Sign Squares 10. There are four Traffic Light Squares 20. There are two Accident Squares 65. There are seven squares which occur only once on the gameboard. They are the Exit Square 5, the Handicapped Square 35, the Turtle Square 45, the School Zone Square 50, the Following Distance Square 55, the Ambulance Square 60, the Rural Detour Square 70 and the Urban Detour Square 75. When a player lands on any of the aforementioned squares, an action occurs which helps the player to learn the rules of the road. The actions will be described below during the discussion of each square and the rules of play.

There are four regions located interiorly of the perimeter of the gameboard. These regions include the Policeman Region 80, the Question Mark Region 85, the Drunk Driver Region 90 and the Traffic Signs Region 95. The Policeman Region 80 is designed to have the Policeman Cards 125 placed thereon. The Question Mark Region 85 is designed to have the Question Mark Cards 120 placed thereon. The Drunk Driver Region 90 is designed to have the Drunk Driver Cards 105 placed thereon. The Traffic Signs Region 95 is designed to have the Traffic Signs Cards 110 placed thereon. The cards are best seen in FIGS. 17–20.

The game further includes one hundred cards, four playing pieces and two dice.

Referring now to FIG. 2, the Exit Square 5 is shown. The Exit Square 5 is double the size of all the other squares. The Exit Square 5 acts as the 'start' point of the game, to simulate entering a roadway via an exit. Starting from Exit Square 5 the players will move their pieces in a clockwise fashion about the playing board.

Referring now to FIG. 3, the Stop Sign Square 10 is shown. There are five Stop Sign Squares 10 located about the board. When a player is moving about the gameboard and passes a Stop Sign Square 10, the player must stop their piece above the Stop Sign Square 10 and say "STOP" aloud. After the player says "STOP", they continue with the rest of their move. If the player proceeds through the Stop Sign Square 10 without stopping 5 points will be deducted from the player's score. The deduction will be recorded on the scorecard. The opposing players must watch for this, for part of the amusement of the game is catching the player "running" the Stop Sign Square 10. If the player "runs" the Stop Sign Square 10 without being caught by the other players, no points are deducted from the player's score. The player may be "caught" by the opposing players up until the next throw of the dice.

Referring now to FIG. 4, the Traffic Signs Square 15 is shown. There are eight Traffic Sign Squares 15 located about the board. When a player lands on a Traffic Sign Square 15 a Traffic Sign Card 110 is drawn from the Traffic Sign Region 95 of the board. The player will be required to select one of a plurality of questions located on the rear of the Traffic Sign Card 110. If the player correctly answers the question, then the player is awarded a certain number of points which are indicated on the lower right hand side of the card. These points will be added onto the scorecard. The questions may be directed the concepts and motorist requirements with respect to different traffic control signs. No points will be awarded for an incorrect answer to the question chosen.

Referring now to FIG. 5, the Traffic Light Square 20 is shown. There are four Traffic Light Squares 20 located on the board. When a player lands on a Traffic Light Square 20 the player must say aloud what a driver is required to do at a Green, Yellow and Red light. If the player answers correctly, the player will be permitted to move double the number of squares based on their roll of the dice in their subsequent turn.

Referring now to FIG. 6, the Drunk Drive Square 25 is shown. There are ten Drunk Driver Squares 25 located on the board. When a player lands on a Drunk Driver Square 25, the player accumulates the percentage amount of alcohol stated on that square on the gameboard. This percentage is noted on the player's scorecard. This percentage of alcohol is analogous to Blood Alcohol Content which is how law enforcement measures intoxication levels. The alcohol percent levels on the Drunk Driver Squares 25 vary from 1% to 10%. The player must further draw a Drunk Driver Card 105 from the Drunk Driver Region 90 of the playing board. The player will be requires to select one of a plurality of questions located on the rear of the Drunk Driver Card 105. If the player correctly answers the question, then the player is awarded a certain number of points which are indicated on the lower right hand side of the card. The questions would be directed to the concepts and motorist requirements with respect to driving while under the influence of alcohol or drugs. No points will be awarded for an incorrect answer to the question chosen.

Figure 7:
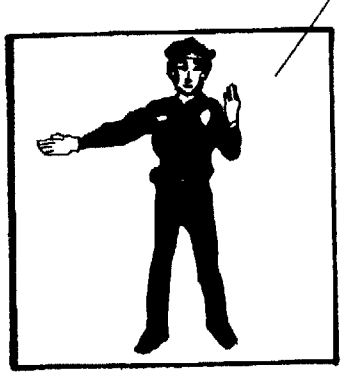
FIG. 7 is a view showing the playing square designated "Policeman".

Referring now to FIG. 7, the Policeman Square 30 is shown. There are eight Policeman Squares 30 located on the playing board. When a player lands on a Policeman Square 30, the percent of alcohol that the player has accumulated up to that point is summed. If the player has accumulated 10% or more (0.1 Blood Alcohol Content) they will be declared "DRUNK" and will have 5 points deducted. These points will be deducted on the scorecard. If the player has less that 10% alcohol on the scorecard, they will be permitted to continue play without a penalty. If the player is determined to be "DRUNK" the alcohol accumulation at that point is brought to zero and indicated as such on the scorecard. Regardless of the accumulation of alcohol at that point the player must also take a Policeman Card 125 from the Policeman Region 80 of the board. The player will be required to select from a plurality of questions located on the rear of the Policeman Card 125. If the player correctly answers the question, then the player is awarded a certain number of points which are indicated on the lower right hand side of the card. The questions would be directed to concepts and motorist requirements with respect to law enforcement. No points will be awarded for an incorrect answer to the question chosen.

Figure 8:
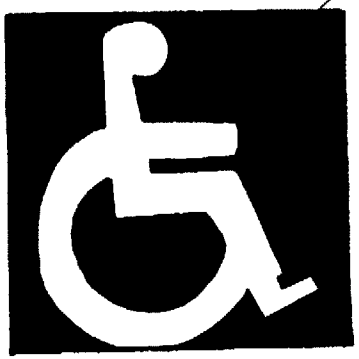
FIG. 8 is a view showing the playing square designated "Disabled Person".

Referring now to FIG. 8, the Disabled Person Square 35 is shown. There is only one Disabled Person Square 35 located on the board. When a player lands on the Disabled Person Square 35 they will have 10 points deducted from their score.

Figure 9:
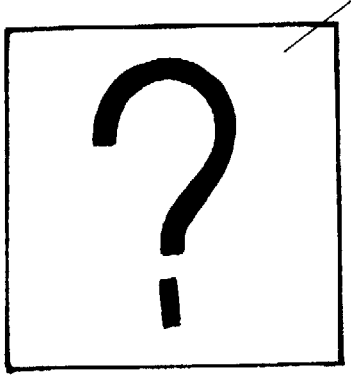
FIG. 9 is a view showing the playing square designated "Question Mark".

Referring now to FIG. 9, the Question Mark Square 40 is shown. There are twelve Question Mark Squares 40 located on the board. When a player lands on a Question Mark Square 40 a Question Mark Card 120 is drawn from the Question Mark Region 85 of the board. The player will be required to select one of a plurality of questions located on the rear of the Question Mark Card 120. If the player correctly answers the question, then the player is awarded a certain number of points which are indicated on the lower right hand side of the card. The questions would be directed to concepts and motorist requirements which are difficult to grasp and as such are found to be difficult to answer correctly when one is taking the Driver's Examination. No points will be awarded for an incorrect answer to the question chosen.

Figure 10:
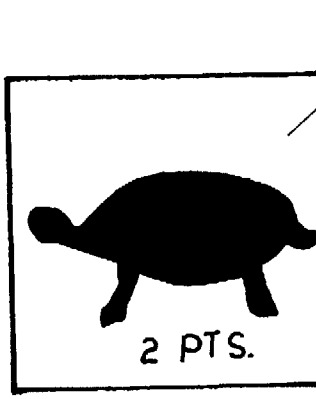
FIG. 10 is a view showing the playing square designated "Turtle".

Referring now to FIG. 10, the Turtle Square 45 is shown. There is only one Turtle Square 45 located on the board. When the player lands on the Turtle Square 45, the player must correctly state aloud where a driver who is driving slow should drive. If the player correctly answers the question, then the player is awarded the points shown on the Turtle Square 45. These points will be added on the scorecard. No points will be awarded for an incorrect answer to the question.

Figure 11:
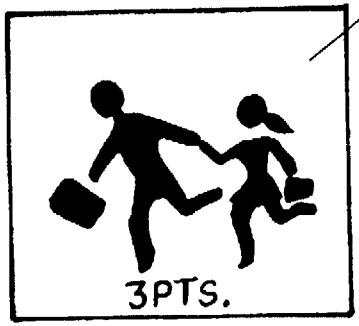
FIG. 11 is a view showing the playing square designated "School Zone".

Referring now to FIG. 11, the School Zone Square 50 is shown. There is only one School Zone Square 50 located on the board. When the player lands on the School Zone Square 50, the player must state the facts concerning: a) the speeds permitted in that zone, b) the associated time when the different speed limits are in effect, c) and which days of the week such limits are in effect. If the player correctly states these facts, 3 points will be awarded. These points will be added on the scorecard. No points will be awarded for an incorrect statement.

Figure 12:
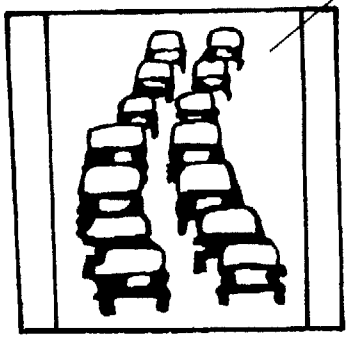
FIG. 12 is a view showing the playing square designated "Following Distance"

Referring now to FIG. 12, the Following Distance Square 55 is shown. There is only one Following Distance Square 55 located on the board. When a player lands on the Following Distance Square 55, the player must state the driver's responsibility is with respect to the correct distance to follow another vehicle. If the player correctly states this distance, 3 points will be awarded. These points will be added on the scorecard. No points will be awarded for an incorrect statement.

Figure 13:
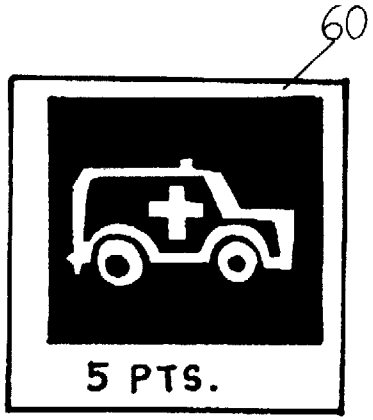
FIG. 13 is a view showing the playing square designated "Ambulance".

Referring now to FIG. 13, the Ambulance Square 60 is shown. There is only one Ambulance Square 60 located on the board. When a player lands on the Ambulance Square 60, the player must state what a driver's responsibility is when an emergency vehicle with a siren approaches. If the player correctly states the driver's responsibilities, 5 points will be awarded. These points will be added on the scorecard. No points will be awarded for an incorrect statement.

Figure 14:
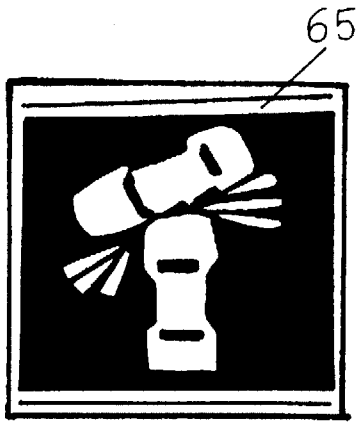
FIG. 14 is a view showing the playing square designated "Accident".

Referring now to FIG. 14, the Accident Square 65 is shown. There are two Accident Squares 65 located on the board. When a player lands on the Accident Square 65, the player has 5 points deducted from their score. These points will be deducted from the player's score on the scorecard.

Figure 15:
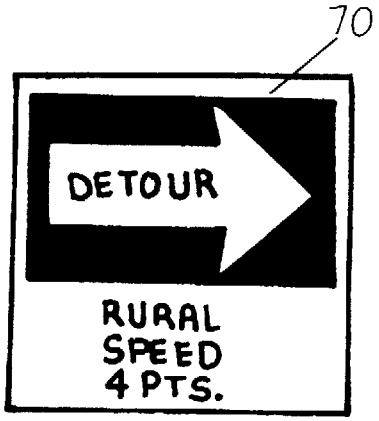
FIG. 15 is a view showing the playing square designated "Detour (Rural)".

Referring now to FIG. 15, the Rural Detour Square 70 is shown. There is only one Rural Detour Square 70 located on the board. When a player lands on the Rural Detour Square 70, the player must state the speed permitted in the rural zone for light and heavy vehicles. If the player correctly states these facts, there will be a 4 point award. It is to be noted that the instant invention may be utilized in many nations where the common terms of the road may be different. In this case, the rural zone may be analogous to non-interstate highways which have certain speed and weight restrictions. The action on this square may be modified to reflect the region or area the game is being played in. Further, the player then must 'detour' following the squares designated by the arrow R.

Figure 16:
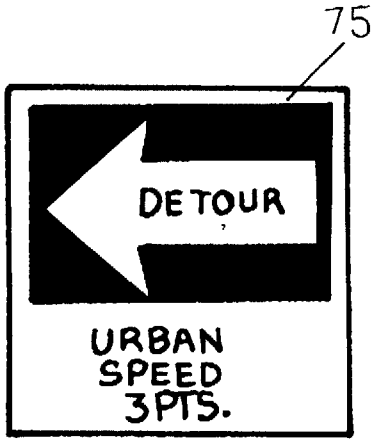
FIG. 16 is a view showing the playing square designated "Detour (Urban)".
Figure 17:
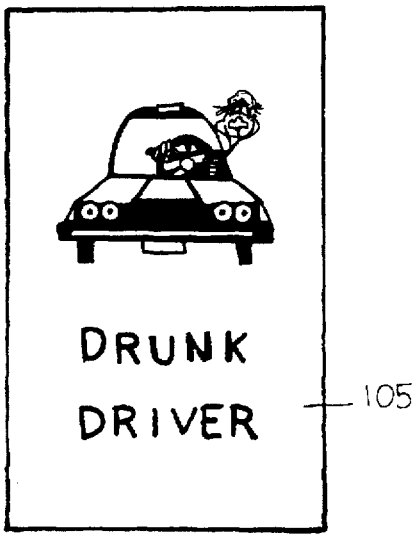
FIG. 17 is a view showing the playing card designated "Drunk Driver".
Figure 18:
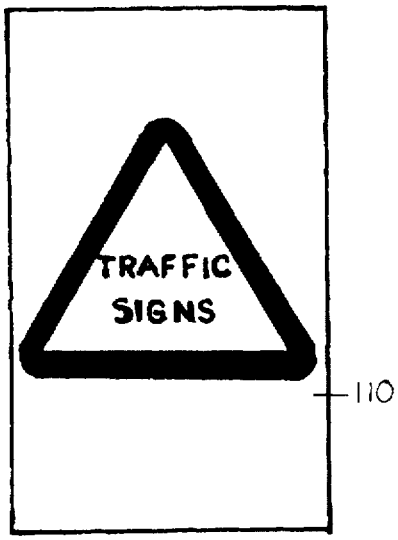
FIG. 18 is a view showing the playing card designated "Traffic Signs".
Figure 19:
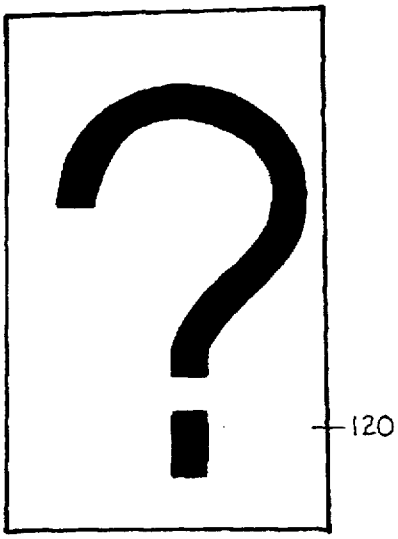
FIG. 19 is a view showing the playing card designated "Question Mark".
Figure 20:
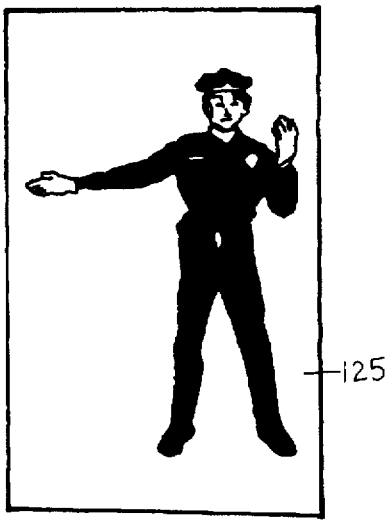
FIG. 20 is a view showing the playing card designated "Policeman".

Referring now to FIG. 16, the Urban Detour Square 75 is shown. There is only one Urban Detour Square 75 located on the board. When a player lands on the Urban Detour Square 75, the player must state the speed permitted in the urban zone for light and heavy vehicles. If the player correctly states these facts, there will be a 3 point award. It is to be noted that the instant invention may be utilized in many areas where the common terms of the road may be different. In this case, the urban zone may be analogous to a city region which have certain speed and weight restrictions. The action on this square may be modified to reflect the region or area the game is being played in. Further, the player then must 'detour' following the squares designated by the arrow U.

It is to be understood that the specific layout of the board may be changed in certain embodiments. The type and frequency of squares may be altered to satisfy different regional requirements. The number of points awarded and deducted may be altered to enhance the play of the game. Alternative squares may be provided in different embodiments of the game.

Referring now to FIGS. 17–20, the playing cards are shown. The Drunk Driver Card 105, Traffic Sign Card 110, Question Mark Card 125 and Policeman Card 125 will be placed in their respective regions on the board. The card, region and square will share the same ornamental appearance, for instance, the image on the Policeman Square 30 is the same as the Policeman Region 80 and is the same as the face of the Policeman Card 125. There are 100 cards, 25 of each type in the preferred embodiment of the game. There are two questions located on each card, each question requiring knowledge of a rule or regulation to correctly answer. The questions may be chosen from sample written driver's license examinations. They may also be chosen to instruct on the consequences of failure to obey such regulations. The player will, as a consequence of playing the educational game, learn the rules of the road, commit them to memory, and be able to easily recall them during the written driver's license examination. It is believed that regular play of the game prior to taking the examination will increase the performance of the player during the exam, and thus will significantly increase the chances of successfully passing the exam. The number of cards, number of questions located on the card, and the ornamental appearance of the cards may be changed in different embodiments of the instant invention.

Figure 21:
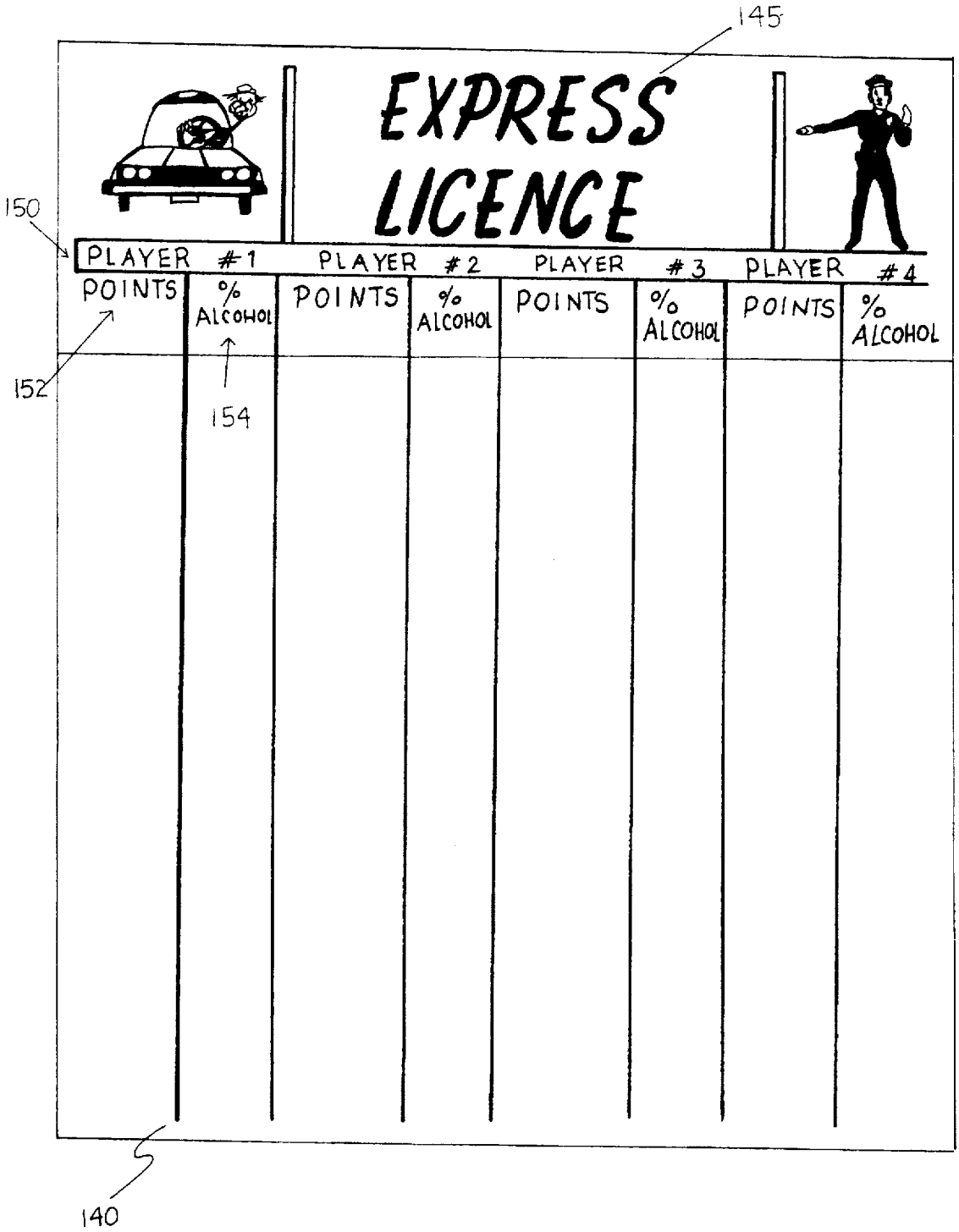
FIG. 21 is a view showing the scorecard to be employed during game play.

Referring now specifically to FIG. 21, a preferred embodiment of the scorecard 140 is shown. The scorecard 140 may have columns for all the players. The scorecard 140 may have one of the preferred names of the game "EXPRESS LICENSE" 145 emblazoned on the top of the scorecard 140. A referee may keep score, the referee would solve any disputes between the players. Alternatively, the players may keep score, but no player may be permitted to keep their own score. The scorecard 140 has columns for four players. The players are indicated at row 150. The points scored for player 1 will be added in the column below the points heading 152. The percent alcohol for player 1 will be added in the column below the percent alcohol heading 154. Players 2–4 will keep their score similarly to player 1.

Rules of Play

Each player will initially choose a playing piece, which may represent a motor vehicle. The playing pieces will be different colors. The players roll the dice to see who begins, the player with the highest roll begins. The playing order will be chosen sequentially and the player with the next highest score will roll second and so on. The first player will then roll two die and enter the board on the Exit Square 5. The player will then take whatever action is required by the playing square in which the playing piece lands.

The players will continue to traverse the playing squares on the board until one of the players accumulates 70 points. The questions may be posed and solved more than once. This helps the players memorize the correct answers. When a card is drawn, and after the play is complete, the card will be returned to the bottom of the deck.

Although a referee or instructor may be present during game play, a guide with preferred solutions to the questions may be provided with the game. This guide may also include sample driver's license examinations along with other materials, such as appropriate Department of Motor Vehicle publications with respect to the rules of the road.

It is apparent from the above that the present invention accomplishes all of the objectives set forth by providing a new and improved new educational game which will increase the player's score on the driver's license written examination, as well as increase the player's knowledge concerning the rules of the road.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved educational board game which assists the players in the preparation for the driver's license examination, the board game comprising:

a gameboard, said gameboard being generally rectangular and having a plurality of squares, said squares defining a path, said path including policeman squares, question mark squares, drunk driver squares, and traffic sign squares, said drunk driver squares including a percent alcohol indication thereon, a plurality of decks of cards, said plurality of decks of cards disposed on said gameboard, said decks including a policeman deck, a question mark deck, a drunk driver deck and a traffic sign deck, each of said decks further having a plurality of questions located thereon, a scorecard, said scorecard to keep track of points awarded when the player correctly solves the question posed on said picked card and to keep track of percent alcohol accumulated by landing on said drunk driver squares, whereby the players move on said path and pick a card from one of said plurality of decks of cards when they land on the associated one of said squares on said path, and must attempt to correctly answer the question posed on said card, wherein said question is relevant to the questions posed on the driver's license examination.

2. The board game as claimed in claim 1 wherein said player is awarded said percent alcohol indication when said player lands on said drunk driver square.

3. The board game as claimed in claim 2 wherein said player's percent alcohol indication is summed on said scorecard.

4. The board game as claimed in claim 3 wherein when said player lands on said policeman square, and if said player's summed percent alcohol indication is above the legal driving limit, said player is declared drunk.

5. The board game as claimed in claim 4 wherein when said player is declared drunk, points are subtracted from said scorecard.

6. The board game as claimed in claim 5 wherein after said player is declared drunk, said summed percent alcohol indication is returned to zero.

7. The board game as claimed in claim 6 wherein said path includes a Detour square.

8. The board game as claimed in claim 7 wherein when said player lands on said Detour square, said player must take an alternate path, said alternate path adjoining a main path, leaving said main path at a first square and re-entering said main path at a second square.

9. The board game as claimed in claim 8 wherein said path includes a Stop square, wherein said player must pause and state aloud that said player is stopped before proceeding.

10. The board game as claimed in claim 9 wherein said path includes a Stop Light square.

11. The board game as claimed in claim 10 wherein said path includes an Accident Square.

12. The board game as claimed in claim 11 wherein said path includes a Turtle square.

13. The board game as claimed in claim 12 wherein said path includes a School Zone square.

14. The board game as claimed in claim 13 wherein said path includes a Following Distance square.

15. The board game as claimed in claim 14 wherein said path includes an Ambulance square.

16. The board game as claimed in claim 1 including dice for determining how far each player will move and markers for indicating the players position on said path.

* * * * *